US011715576B2

(12) United States Patent
Ripert et al.

(10) Patent No.: US 11,715,576 B2
(45) Date of Patent: Aug. 1, 2023

(54) PACKAGE FOR TRANSPORTING AND/OR STORING RADIOACTIVE MATERIALS, COMPRISING A RADIOLOGICAL PROTECTION DEVICE REDUCING RISKS OF RADIOLOGICAL LEAKS

(71) Applicant: Orano Nuclear Packages and Services, Montigny le Bretonneux (FR)

(72) Inventors: Hervé Ripert, Paris (FR); Yves Gourdon, Courbevoie (FR); Frédérick Bordes, Guyancourt (FR)

(73) Assignee: Orano Nuclear Packages and Services, Montigny le Bretonneux (FR)

( * ) Notice: Subject to any disclaimer, the term of this patent is extended or adjusted under 35 U.S.C. 154(b) by 33 days.

(21) Appl. No.: 17/492,900

(22) Filed: Oct. 4, 2021

(65) Prior Publication Data

US 2022/0108811 A1 Apr. 7, 2022

(30) Foreign Application Priority Data

Oct. 7, 2020 (FR) ..... 2010235

(51) Int. Cl.

| | |
|---|---|
| ***G21F 5/02*** | (2006.01) |
| ***G21F 1/10*** | (2006.01) |
| ***G21F 5/12*** | (2006.01) |

(52) U.S. Cl.

CPC ..... *G21F 5/02* (2013.01); *G21F 1/10* (2013.01); *G21F 5/12* (2013.01)

(58) Field of Classification Search

CPC ..... G21F 5/02; G21F 1/10; G21F 5/12
USPC ..... 250/505.1, 506.1, 515.1, 516.1, 517.1, 250/518.1, 519.1
See application file for complete search history.

(56) References Cited

U.S. PATENT DOCUMENTS

2021/0343438 A1* 11/2021 Singh ..... G21F 5/12

FOREIGN PATENT DOCUMENTS

| | | |
|---|---|---|
| DE | 2108855 A1 | 11/1971 |
| EP | 0942435 A1 | 9/1999 |
| FR | 3060192 A1 | 6/2018 |

OTHER PUBLICATIONS

Search Report for French application No. 2010235 dated Jun. 21, 2021.

* cited by examiner

*Primary Examiner* — Nicole M Ippolito
(74) *Attorney, Agent, or Firm* — Pearne & Gordon LLP

(57) ABSTRACT

A package for transporting and/or storing radioactive materials, comprises a cavity for housing radioactive materials, as well as a radiological protection device comprising radiological protection elements arranged in an annular space, at least two successive radiological protection elements along a given direction of the annular space, from a longitudinal direction and a circumferential direction, and a locking member designed to limit and/or prevent the distancing of the two radiological protection elements relative to one another in a given direction.

19 Claims, 8 Drawing Sheets

PACKAGE FOR TRANSPORTING AND/OR STORING RADIOACTIVE MATERIALS, COMPRISING A RADIOLOGICAL PROTECTION DEVICE REDUCING RISKS OF RADIOLOGICAL LEAKS

CROSS-REFERENCE TO RELATED APPLICATIONS

Priority is claimed from French Patent Application No. 2010235 filed on Oct. 7, 2020, the content of which is incorporated herein by reference herein in its entirety.

TECHNICAL FIELD

The present invention relates to the field of packages for transporting and/or storing radioactive materials, for example nuclear fuel assemblies or radioactive waste.

More specifically, the invention relates to a package comprising a radiological protection device formed by a plurality of separate elements, for example cast resin radiological protection elements.

PRIOR ART

Providing a package equipped with a radiological protection device arranged around a cavity for housing radioactive materials is known from the prior art. The function sought with this device lies in protection against gamma radiation, and/or in neutron absorption with a view to meeting regulatory radiological criteria around the package, when the latter is loaded with radioactive materials.

For this purpose, one solution consists of inserting radiological protection elements in an annular space centred on the longitudinal central axis of the package. These elements usually take the form of blocks, which, thanks to a cold gap, can be inserted into the annular space. This cold gap also allows the thermal expansion of the radiological protection material, and thus limits the thermomechanical stress of these blocks on the parts of the package that define the annular space.

During transport operations performed with this type of package, the radiological protection elements can move and slide in relation to one another in the annular space. The cumulative movements between these elements can result locally, between two adjacent elements, in the appearance of a gap of an unacceptable value with regard to radiological leaks.

Consequently, there is a need to optimise the design of existing packages, in order to remedy the drawback described above.

DESCRIPTION OF THE INVENTION

To meet this need, the invention relates to a package for transporting and/or storing radioactive materials, comprising a cavity for housing radioactive materials, as well as a radiological protection device arranged around the housing cavity in an annular space centred on a longitudinal central axis of the package, the radiological protection device comprising radiological protection elements arranged in the annular space.

According to the invention, associated with at least two successive radiological protection elements in a given direction of the annular space, from a longitudinal direction and a circumferential direction of this space, a locking member designed to limit and/or prevent the distancing of the two radiological protection elements relative to one another in the given direction is provided in the space, the locking member cooperating with or being integrated in a first element from said two radiological protection elements, and cooperating with a hollow formed on a second element from these two radiological protection elements.

The invention advantageously makes it possible to limit the distancing between the radiological protection elements in the annular space of the package, with as a result a substantial reduction in the risk of radiological leaks between these radiological protection elements.

The invention moreover has at least any one of the following optional features, taken in isolation or in combination.

According to a preferred embodiment of the invention, the locking member is integral with the first radiological protection element.

Preferably, the locking member is a longilinear member, preferably having a cross-section in the shape of a truncated disk, square or trapezium. Further shapes can obviously be selected, without leaving the scope of the invention.

Preferably, the longilinear locking member extends orthogonally or substantially orthogonally to said given direction.

According to a further preferred embodiment of the invention, the locking member is a separate part from the first and second radiological protection elements, and this locking member also cooperates with a hollow formed on the first radiological protection element.

Preferably, the locking member is a part of smaller size than that of the first and second radiological protection elements, and preferably made of a different material.

Preferably, the locking member is a pin, a key, or a clip.

Preferably, the locking member only extends over a portion of the radial thickness of the annular space.

According to a preferred embodiment of the invention, the first and second radiological protection elements are directly consecutive in said given direction, in a single annular row of radiological protection elements.

According to a further preferred embodiment of the invention, the first and second radiological protection elements belong respectively to two concentric annular rows of radiological protection elements, the first and second radiological protection elements being thus circumferentially offset relative to one another while partially overlapping in a radial direction of the annular space.

Preferably, the locking member is located at the level of a radial overlap zone of the first and second radiological protection elements.

Preferably, the annular space is defined by an inner ferrule and an outer casing. In this regard, it is noted that the inner ferrule can form all or part of the lateral body of the package, or indeed this inner ferrule can be provided in addition to the lateral package body delimiting the cavity for housing radioactive materials.

Preferably, the annular space is devoid of heat conductors connecting the inner ferrule to the outer casing.

Preferably, the radiological protection elements are neutron protection elements, preferably cast resin blocks.

Preferably, at least one radiological protection element of the radiological protection device, and preferably several of these elements, or even each thereof, is associated with two locking members designed to limit and/or prevent the distancing thereof, in said given direction, respectively relative to each of the two radiological protection elements located on either side thereof in this same given direction. This arrangement, which limits the risks of the accumulation of gaps between the different radiological protection elements, is applicable both to the configuration with a single annular row and to the configuration with two concentric annular rows of radiological protection elements.

Further advantages and features of the invention will emerge in the non-limiting detailed description below.

BRIEF DESCRIPTION OF THE DRAWINGS

This description will refer to the appended drawings wherein.

DETAILED DESCRIPTION OF PREFERRED EMBODIMENTS

Figure 1:
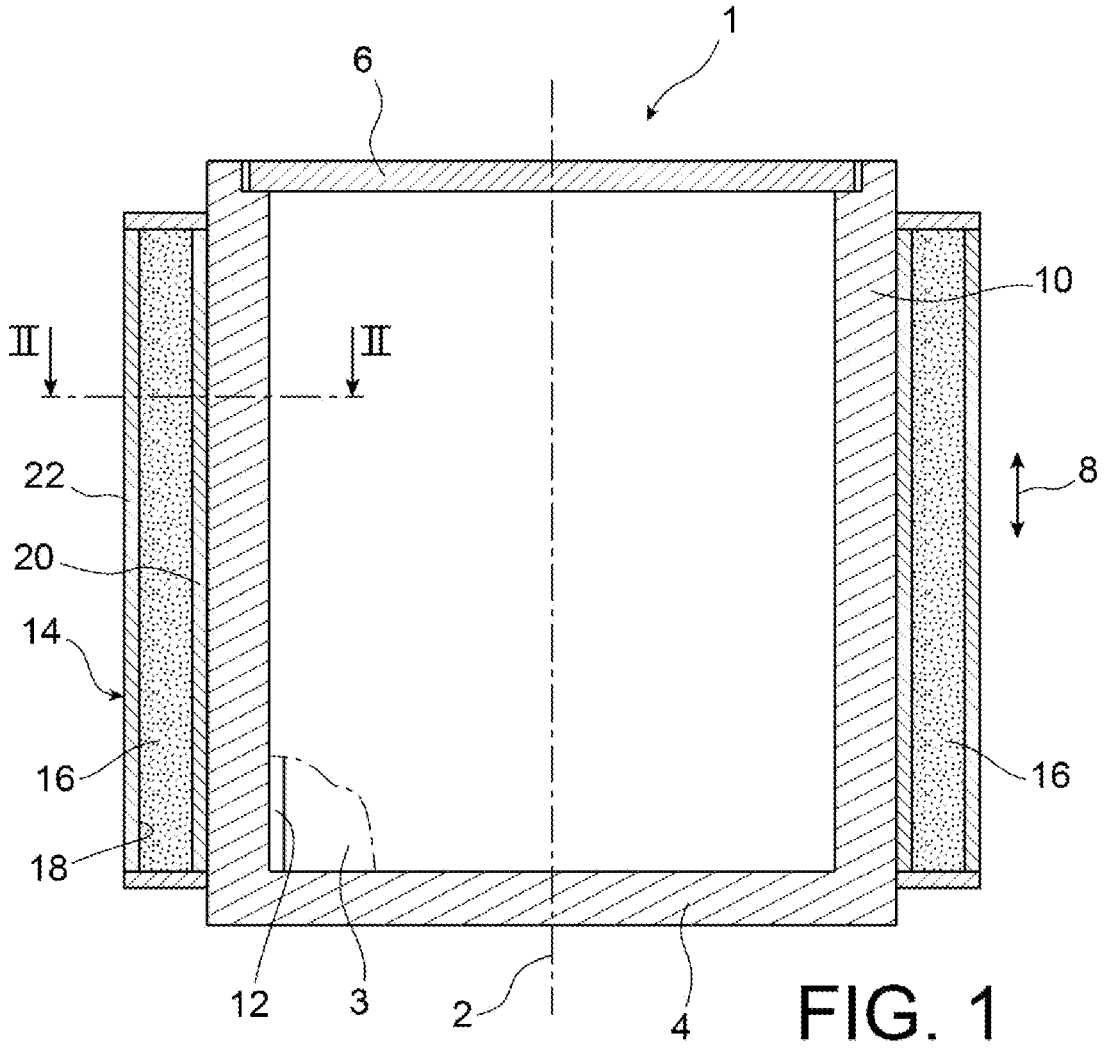
FIG. 1 represents a schematic longitudinal axial sectional view of a package for transporting and/or storing radioactive materials, according to a preferred embodiment of the present invention.

With reference first of all to FIG. 1, a package 1 for transporting and/or storing radioactive materials, such as nuclear fuel assemblies 3 or radioactive waste (represented only partially and schematically in FIG. 1), is represented.

This package 1 is represented in the vertical storage position, wherein the longitudinal central axis 2 thereof is vertically oriented. It rests on a package base 4, opposite a removable cover 6 along the direction of the height 8, parallel with the longitudinal axis 2. The direction of the height 8 thus corresponds to the longitudinal direction of the package.

Between the base 4 and the cover 6, the package 1 includes a lateral body 10 extending about the axis 2, and delimiting internally a cavity 12 for housing radioactive materials 3. This cavity 12 can form a containment enclosure intended to receive the radioactive materials, for example arranged in a storage tray also located in the containment enclosure. Alternatively, the containment enclosure is defined entirely by a case, also known as a "canister", placed in the cavity 12 cited above. The enclosure is closed axially at the top by the cover 6, and at the bottom by the base 4, which can be integral with the lateral body 10 of the package. Indeed, these elements 4, 6 and 10 form the body of the package, intended in particular to ensure the mechanical strength of the package in the event of a fall, so as to retain the tightness of the containment enclosure.

At the periphery thereof, the package 1 is also equipped with a radiological protection device, here a neutron protection device 14. This device is formed using several neutron protection elements 16, which each extend along all or part of the length of the lateral body 10 of the package, along the direction 8. Alternatively, the device 14 could be formed using blocks 16 stacked along the direction 8. Each radiological protection element 16 takes the form of a prefabricated block, preferably made of cast resin. This resin can comprise boron or any other neutron-absorbing element, i.e. neutron-absorbing elements. The term "neutron-absorbing elements" denotes elements which have an effective cross-section greater than 100 barns for thermal neutrons.

Hereinafter, the neutron protection elements 16 will be referred to as "protection blocks 16" or "blocks 16". The latter are arranged in an annular space 18 centred on the axis 2, and defined by an inner ferrule 20 and an outer casing 22. In the preferred embodiment shown in FIG. 1, the inner ferrule 20 is a part added around the lateral body 10 of the package, but alternatively, the internal delimitation of the annular space 18 could be performed directly by the outer surface of the lateral body 10. The outer casing 22 forms for its part the lateral periphery of the package 1.

Figure 2:
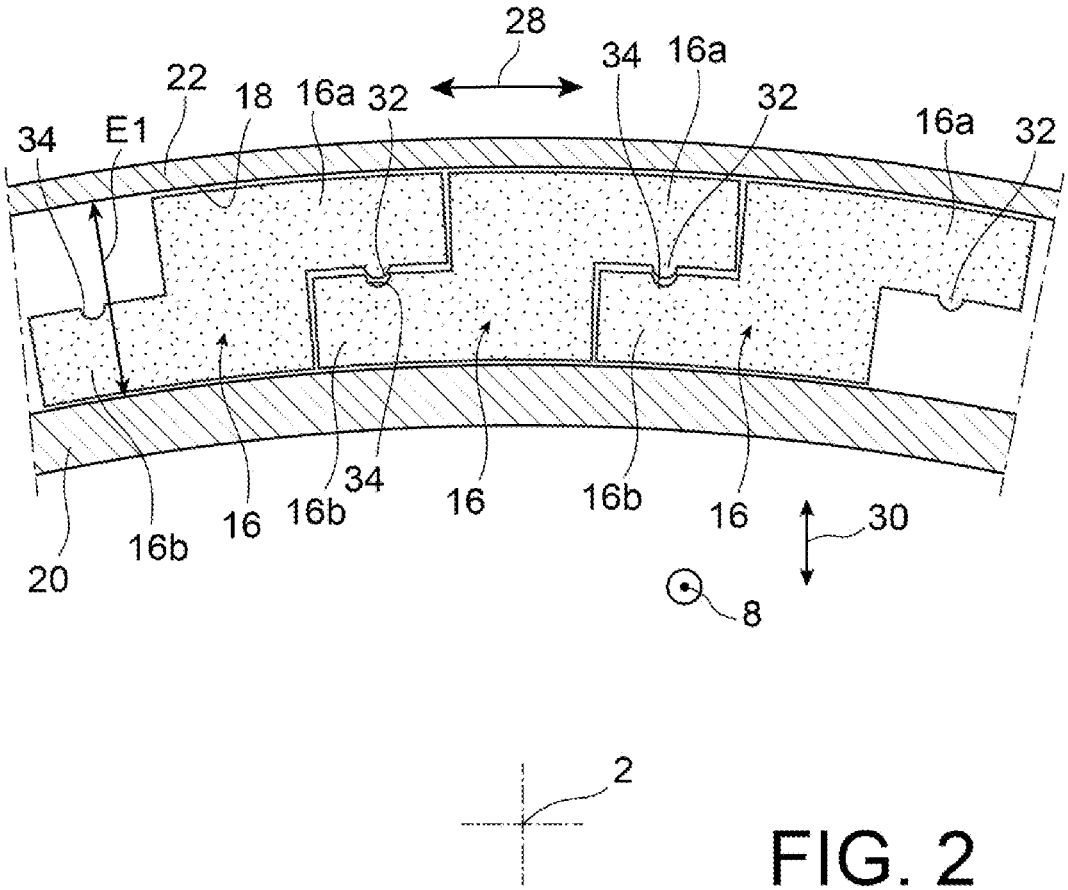
FIG. 2 represents a cross-sectional view taken along the line II-II of FIG. 1.
Figure 3:
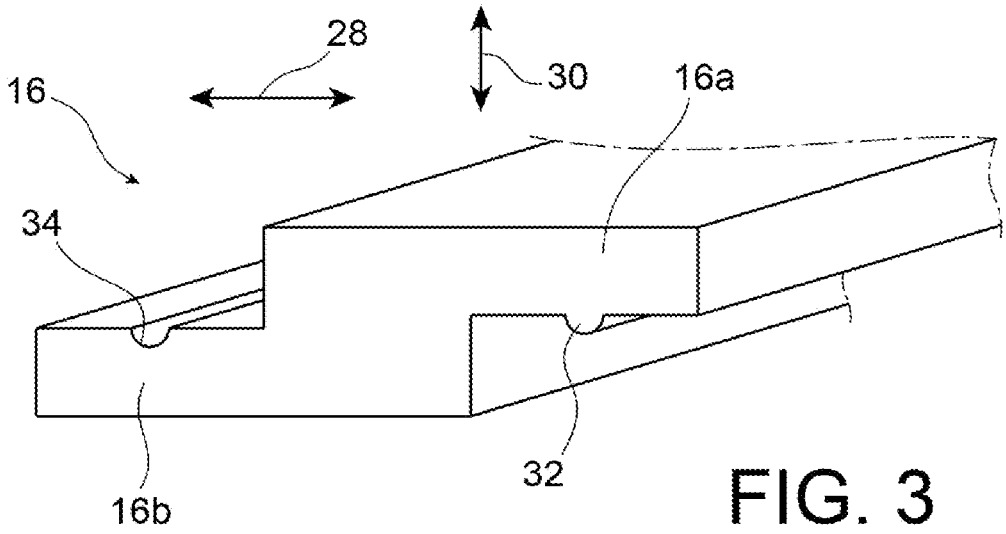
FIG. 3 represents a perspective view of a radiological protection element used in the package shown in FIGS. 1 and 2.

The elements 4, 6, 10 of the package body can be metallic, for example made of steel or cast iron. The inner ferrule 20 and the outer casing 22 can also be metallic, for example made of steel. In the annular space 18, also known as the inter-ferrule space, no heat conductors are preferably provided in addition to the protection blocks 16. This specific case corresponds to packages intended to transport radioactive materials only emitting a low thermal power, or none. The term "heat conductors" denotes conductors conventionally used in packages, generally arranged alternating with the neutron protection blocks and connecting the inner ferrule 20 to the outer casing 22. Nevertheless, heat conductors in annular disk form could be envisaged. The blocks 16 then alternate with the heat conduction disks in the direction 8. With reference now to FIGS. 2 and 3, the shape of the successive blocks 16 along the circumferential direction 28 of the annular space 18 is shown, relative to the axis 2. In this preferred embodiment, all the blocks 16 form a single annular row of blocks, centred on the axis 2, and having a thickness slightly less than the total thickness "E1" of the annular space 18 along the radial direction 30 of this space.

Here, each block 16 of the annular row is preferably identical, namely of the same shape and same dimensions. Generally, each block 16 is made of one piece by two substantially parallelepipedal portions **16*a*, 16*b* offset relative to one another along the circumferential direction 28, as well as along the radial direction 30. Indeed, the first portion 16*a* forms a radially outer part of the block 16, connected and offset circumferentially from a second portion 16*b*** forming the radially inner part of the same block.

Thanks to the succession of blocks 16 along the circumferential direction 28, the first portion **16*a* of a first block covers, in the radial direction, at least partially the second portion 16*b* of a second directly consecutive block 16 in the circumferential direction 28, in the same way as the second portion 16***b* of the first block is covered, in the radial direction, at least partially by the first portion 16*a* of a third directly consecutive block 16 in the circumferential direction 28, but arranged opposite the second.

One of the specificities of the invention lies in the use of means for limiting and/or preventing circumferential distancing between the adjacent blocks 16, and thus avoiding that the accumulation of such distancing cannot result in neutron leaks of an unacceptable level between two directly consecutive blocks 16. For this purpose, it is preferably provided that several blocks 16 of the single annular row, and preferably all or almost all thereof, are each associated with two locking members 32 intended to limit and/or prevent the circumferential distancing thereof, respectively relative to each of the two blocks 16 located on either side thereof in the circumferential direction 28.

It is noted that in all the preferred embodiments, as seen from the description as a whole, the annular space 18 of the package is delimited radially outwards by the outer casing 22 centred on the axis 2, the space 18 wherein the radiological protection elements 16 and the locking members 32 are arranged.

The arrangement between a locking member 32 and the two blocks 16 thereof of which it limits and/or prevents distancing being the same at the level of each of the locking members, only one will be described in detail hereinafter.

In this preferred embodiment, each locking member 32, located in the annular space 18, is integral with the first portion 16*a* of the associated first block 16 thereof. Alternatively, it could be integrated in the second portion 16*b*, without leaving the scope of the invention.

In the case of integration of the locking member 32 in the first portion 16*a* of the first block 16, this member 32 takes the form of an inward radial protrusion extending in a longilinear manner along the longitudinal direction 8, i.e. locally orthogonally or substantially orthogonally to the circumferential direction 28. The longilinear protrusion 32 thus extends preferably continuously along the entire length of the first associated block 16, or merely along a portion thereof. In a cross-section as in FIG. 2, the protrusion 32 has a truncated disk shape, for example a half-disk, or any other shape such as a square, a rectangle, a trapezium, etc.

The protrusion 32 is housed in a hollow 34 of complementary shape, outwardly radially open and provided on the second portion 16*b* of a second block 16 directly adjacent to the first block along the circumferential direction 28. Due to the cooperation between the protrusion 32 and the hollow 34, the first and second protection blocks 16 cannot distance from one another along the circumferential direction 28, or merely over a limited amplitude through use of the circumferential gap between these two parts 32, 34.

Finally, it is noted that the cooperation between the protrusions 32 and the hollows 34 of the different blocks 16 is obtained from the insertion of each thereof in the annular space 18, by relative sliding of each protrusion 32 in the associated hollow 34 thereof, in the form of a trough.

The preferred embodiment described above is moreover found to be transposable to the case of a series of protection blocks 16 along the longitudinal direction 8, in the annular space 18. This case is represented in FIG. 4, wherein the locking members 32 are still in the form of radial protrusions, but extending here in a longilinear fashion along the circumferential direction 28, like the hollows 34 wherein these protrusions 32 are inserted.

By way of indication, during the manufacture of the package, the insertion of the locking member 32 of a block 16, in the hollow 34 of a directly consecutive block in the longitudinal direction 8, is performed before the corresponding parts of these two blocks 16 are inserted longitudinally in the annular space 18.

Figure 4:
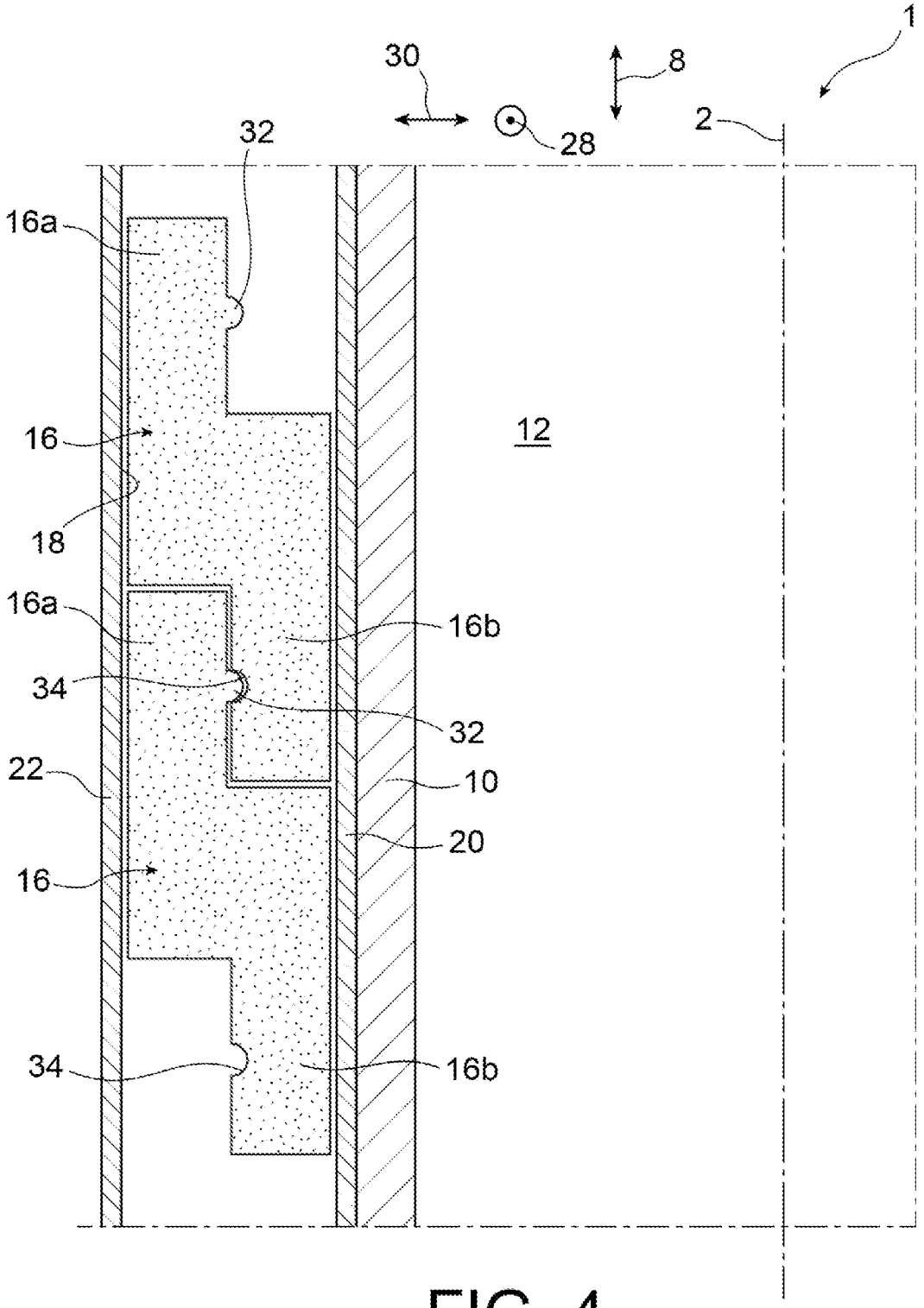
FIG. 4 represents a longitudinal axial sectional view of a part of a package presented according to a further preferred embodiment of the present invention.
Figure 5:
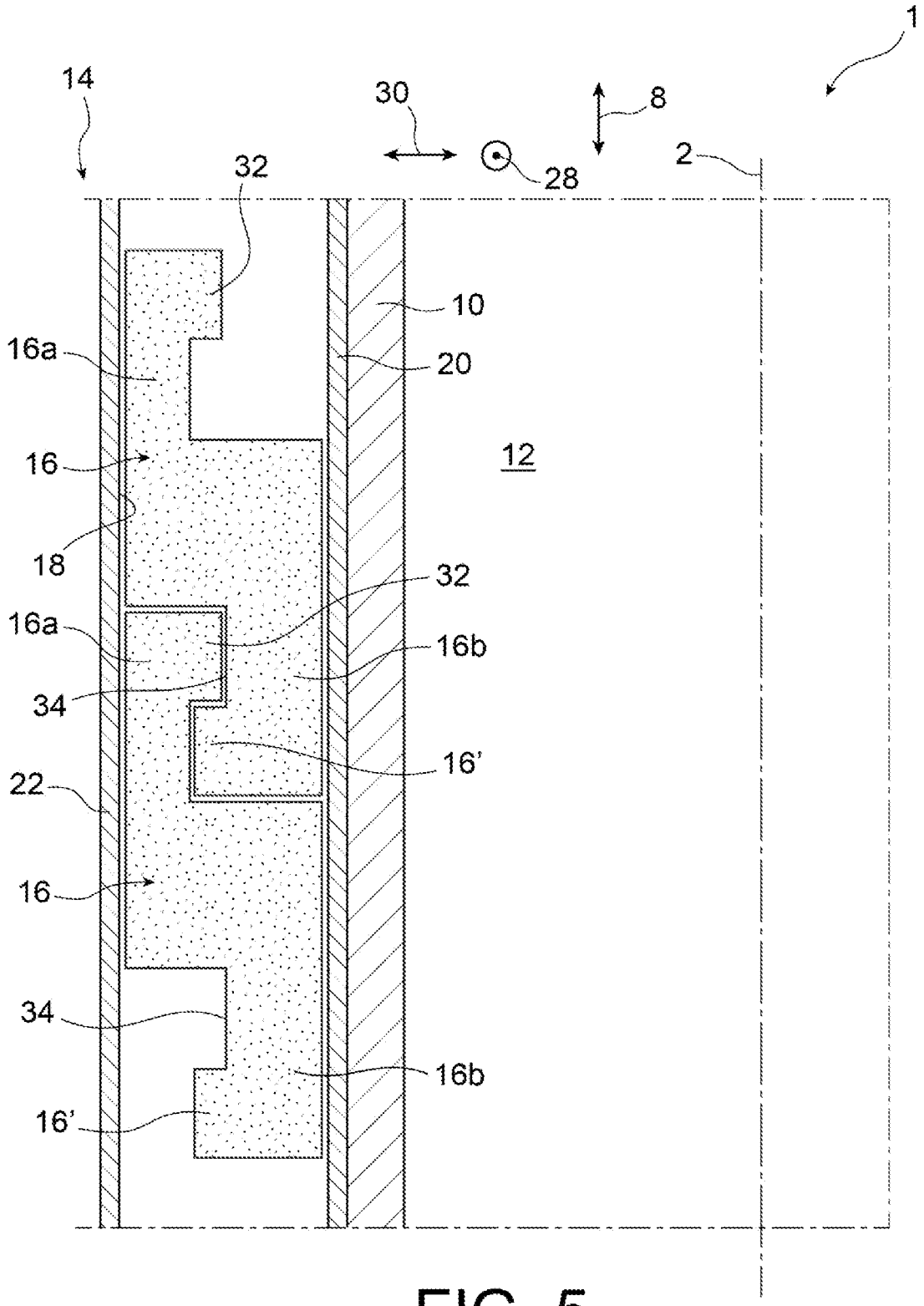
FIG. 5 represents a similar view to that of FIG. 4, with the package presented according to an alternative.

FIG. 5 represents an alternative to the solution proposed in FIG. 4. Here, the locking member 32 forms a longitudinal end of the first portion 16*a* of the block 16, still protruding radially inwards. Furthermore, the hollow 34 of the protection block 16 is formed between, on one hand, the junction between the two portions 16*a*, 16*b* thereof, and, on the other, a further protrusion 16' projecting radially outwards and forming an opposite longitudinal end of this block 16, provided on the second portion 16*b*.

Figure 6:
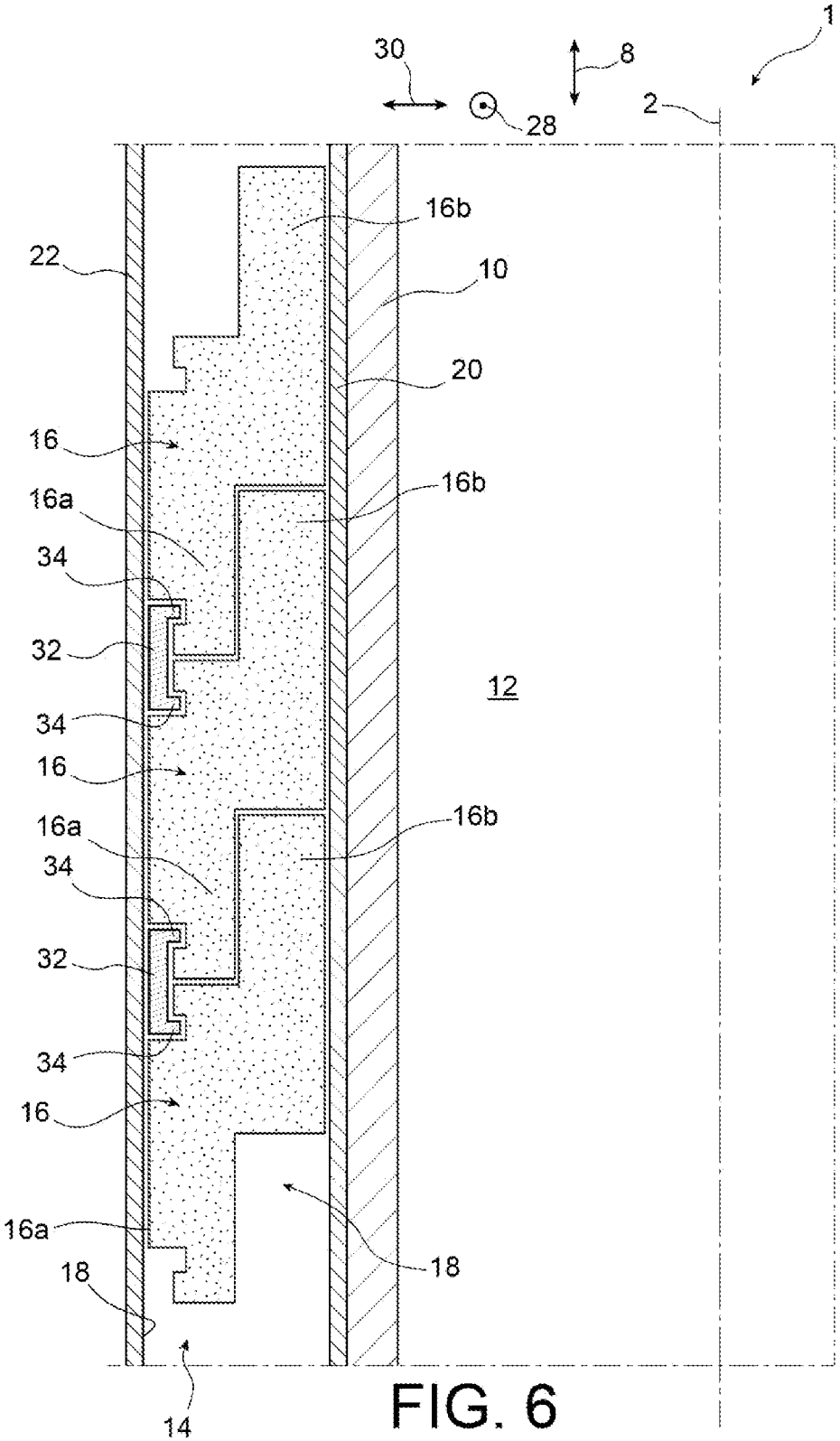
FIG. 6 is a similar view to that of FIG. 4, with the package presented according to a further preferred embodiment of the present invention.

Once again in the context of a single row of protection elements 16, it is possible to provide that the mutual retention of these blocks 16 is performed by locking members not integrated in these blocks, but separate and cooperating therewith. A preferred embodiment in this respect is shown in FIG. 6, wherein the blocks 16 still adopt the same general shape with the two portions 16*a*, 16*b* thereof. The locking members 32 take the form of clips or similar elements, each coupling two directly consecutive blocks 16 in the longitudinal direction 8 to limit and/or prevent the relative distancing thereof along the same direction in the annular space 18.

Each clip 32 thus has two tabs respectively housed in two hollows 34 of the first and second protection block 16 connected thereby. The central body of each clip 32 extends along the circumferential direction 28, and the tabs thereof arranged at the ends of this body protrude radially to be housed in the corresponding hollows 34 of the blocks 16.

As seen in FIG. 6, the clips 32 are arranged at the level of the longitudinal junctions between the blocks 16, being placed on the outer periphery of the annular row of blocks, between the latter and the outer casing 22. Alternatively, the clips 32 could be placed on the inner periphery of the annular row, between the blocks and the inner ferrule 20.

This clip system could also be used in a similar way to limit and/or prevent relative distancing between the blocks 16 along the circumferential direction 28, without leaving the scope of the invention.

Figure 7:
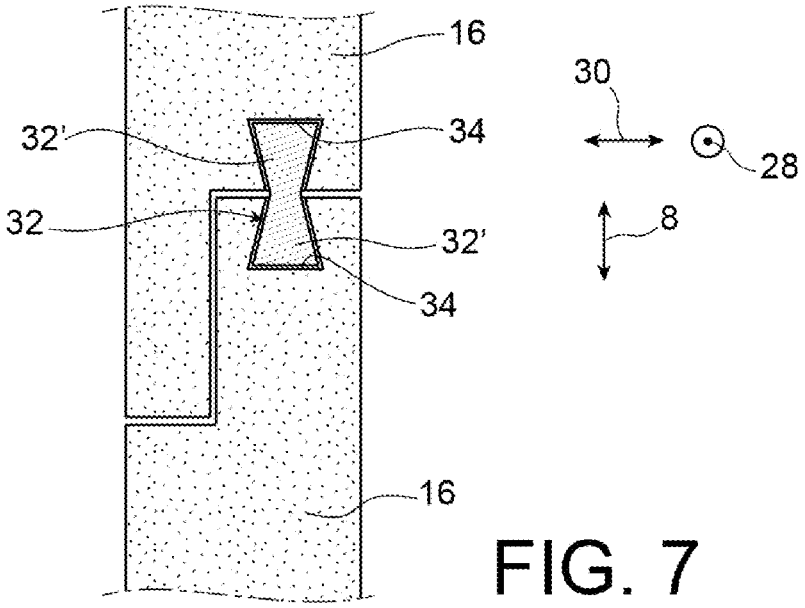
FIG. 7 is a schematic view representing a further preferred embodiment of the radiological protection device equipping the package.

With reference now to FIG. 7, a further preferred embodiment for coupling the blocks 16 in the longitudinal direction 8 with separate locking members 32 from these blocks is represented. This involves a key type or similar design, having two opposite longitudinal portions 32' each in the shape of dovetails, housed respectively in hollows 34 of complementary shape formed on the longitudinal ends facing the two blocks in question 16. In this embodiment, each block 16 has a curvature along the circumferential direction 28 to follow the general shape of the annular space 18 wherein it is located.

In all the embodiments envisaged with separate locking members 32 from the protection blocks 16 connected thereby, these members 32 each form a part of smaller size than that of the blocks 16. Moreover, each locking member 32 only extends along a part of the radial thickness E1 of the annular space 18, for example along 5 to 30% of this thickness.

The locking members 32 are preferably made of a different material from that of the blocks 16, for example a metallic material.

All of the principles associated with the preferred embodiments described above are applicable to the designs wherein the protection device 14 comprises two or more concentric annular rows of protection blocks 16, centred on the axis 2.

Figure 8:
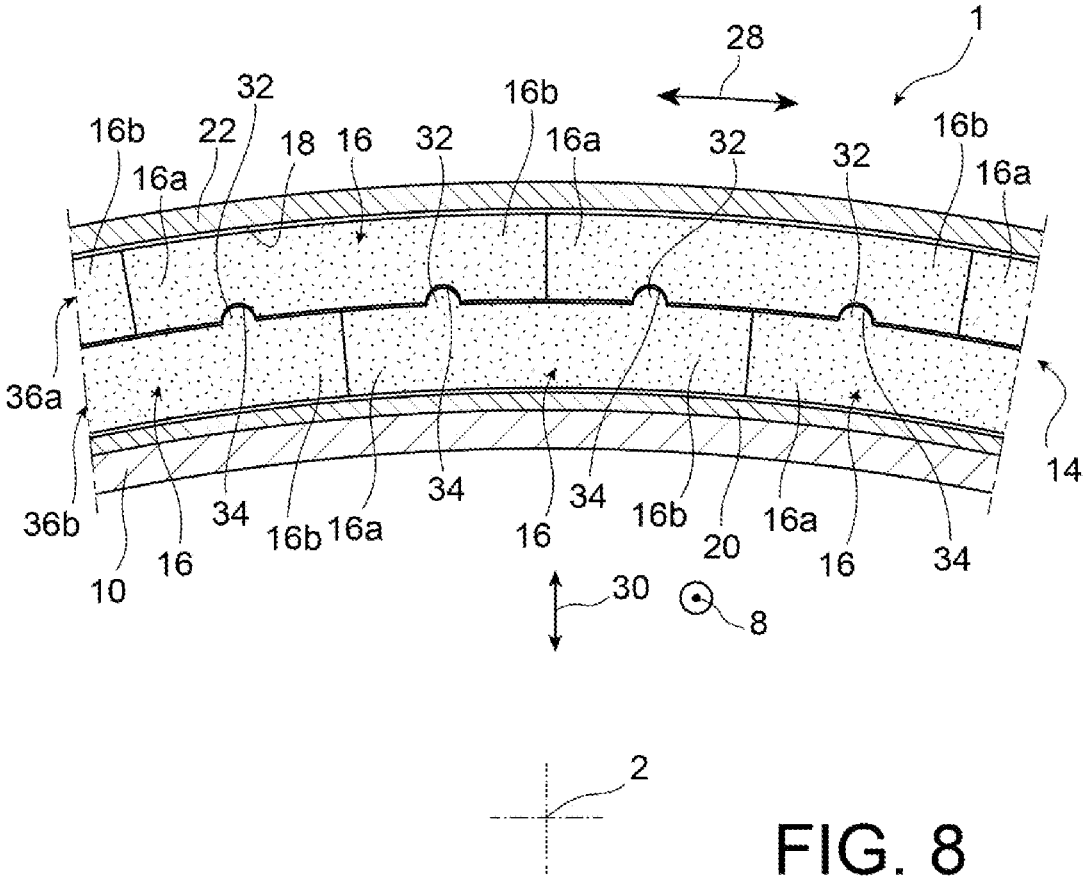
FIG. 8 is a similar view to that of FIG. 2, with the package presented according to a further preferred embodiment of the present invention, wherein the radiological protection device has two concentric annular rows of radiological protection elements.

In the preferred embodiment of FIG. 8, this consists of two concentric rows 36*a*, 36*b* arranged in the annular space 18, each of these rows being formed by the series of protection blocks 16 along the circumferential direction 28. Each block 16 extends along all or part of the length of the lateral body 10 of the package, along the direction 8. It has a simple shape, for example generally parallelepipedal, with optionally a curvature along the circumferential direction 28 to follow the general shape of the annular space 18 wherein it is located. Here, each block 16 of each of two rows 36*a*, 36*b* is preferably made of one piece, comprising a first portion 16*a* as well as a second portion 16*b* located in the circumferential extension of the first portion 16*a*. An angular positioning offset is adopted between the blocks 16 of the first row 36*a* located radially outwards, and the blocks 16 of the second row 36*b* located radially inwards, such that the interfaces between the blocks 16 of the first row 36*a* are not radially aligned with the interfaces between the blocks of the second row 36*b*. This arrangement, comparable to a staggered row arrangement of the blocks 16 forming the two rows 36*a*, 36*b*, makes it possible to limit neutron leaks through these interfaces.

In this configuration, each block 16 of the first row 36*a* has the first portion 16*a* thereof covered by the second portion 16*b* of one of the blocks of the second row 36*b*, in the same way as the second portion 16*b* thereof is covered by the first portion 16*a* of the directly consecutive block in the second row 36*b*. The same applies for each block 16 of the second row 36*b*, in which the first portion 16*a* is covered by the second portion 16*b* of one of the blocks of the first row 36*a*, and in which the second portion 16*b* is covered by the first portion 16*a* of the directly consecutive block in the first row 36*a*. Thus, a circumferential offset can be observed between two blocks 16 belonging respectively to the two rows 36*a*, 36*b*, and which partially overlap one another.

In other words, the first portion 16*a* of a first block 16 of the second row 36*b* is covered, in the radial direction 30, by the second portion 16*b* of a second block 16 of the first row 36*a*, and the second portion 16*b* of this first block is covered, still in the radial direction 30, by the first portion 16*a* of a third block 16 of the first row 36*a*, the second and third blocks 16 being directly consecutive in the circumferential direction 28 in the first row 36*a*. Similarly, the first portion 16*a* of a first block 16 of the first row 36*a* is covered, in the radial direction 30, by the second portion 16*b* of a second block 16 of the second row 36*b*, and the second portion 16*b* of this first block is covered, still in the radial direction 30, by the first portion 16*a* of a third block 16 of the second row 36*b*, the second and third blocks 16 being directly consecutive in the circumferential direction 28 in the second row 36*b*. Moreover, it is stated that when two blocks 16 partially cover one another along the radial direction 30, these same blocks 16 are considered as successive along the circumferential direction 28, even if they do not belong to the same annular row.

In this preferred embodiment of the invention, each protection block 16 of the second row 36*b* includes two locking members 32 spaced circumferentially in relation to one another, the first being in the first portion 16*a*, and the second being in the second portion 16*b*. Moreover, each protection block 16 of the first row 36*a* includes two hollows 34 spaced circumferentially in relation to one another, the first being in the first portion 16*a*, and the second being in the second portion 16*b*. Thus, each protection block 16 of the second row 36*b* has the first locking member 32 thereof inserted in the second hollow 34 of a block 16 of the first row 16*a*, whereas the second locking member 32 thereof is inserted into the first hollow 34 of the directly consecutive block 16 in the first row 16*a*. Thus, in this embodiment, the locking member 32 is located at the level of a radial overlap zone of the two blocks 16 that it helps retain relative to each other, thus helping limit/prevent the relative gap between these two same blocks along the circumferential direction 28.

Naturally, the design could be inverted by providing the protruding members 32 on the blocks of the first row 36*a* and the hollows 34 on the blocks of the second row 36*b*, without leaving the scope of the invention.

In the preferred embodiment of FIG. 8, the radially protruding locking members 32 are identical or similar to those described with reference to FIG. 2, namely particularly having a cross-section in the form of a half-disk. However, all the other features described with reference to FIG. 2 are also applicable, such as the longilinear nature of the members 32 along the longitudinal direction 8, etc.

Figure 9:
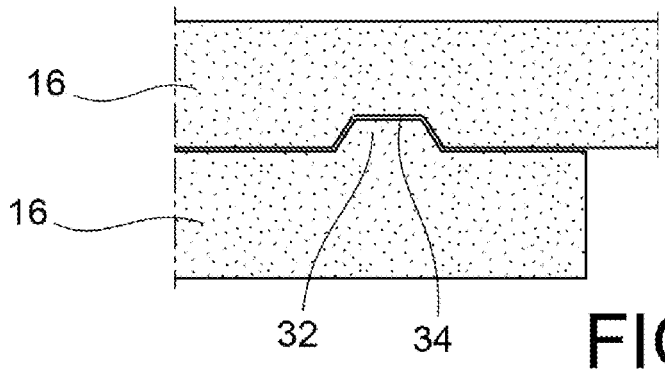
FIG. 9 is a schematic view showing a different form for the locking members equipping the radiological protection device.

According to a further possible embodiment, briefly represented schematically in FIG. 9, the radially protruding locking members 32 can have a trapezoidal shape, like the hollows 34 with which they cooperate.

Figure 10:
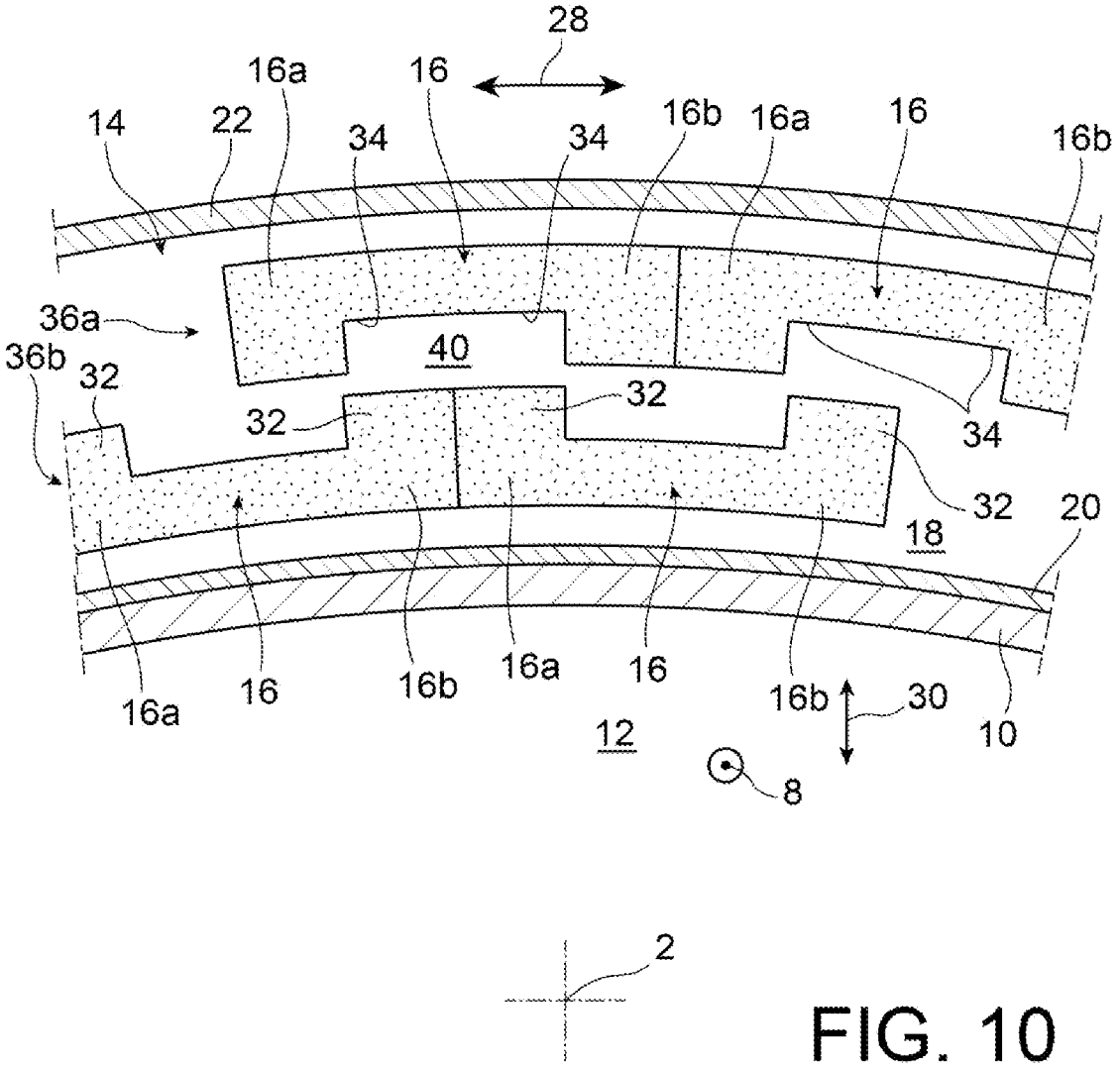
FIG. 10 is a partially exploded cross-sectional view, showing a further preferred embodiment of the radiological protection device with two concentric annular rows of radiological protection elements.

According to a further preferred embodiment, represented in FIG. 10, the two concentric annular rows 36*a*, 36*b* are formed by blocks 16 each having a general U-shaped cross-section. The second row 36*b* includes U-shaped blocks 16 wherein the two opposite arms protrude radially outwards, whereas the first row 36*a* includes U-shaped blocks 16 wherein the two opposite arms protrude radially inwards.

The two arms of each block 16 of the second row 36*b* respectively form the two locking members 32 of this block, whereas the space 40 defined between the two arms of each block 16 of the first row 36*a* forms two adjacent hollows 34 merging circumferentially into one another, and intended to receive two arms and/or members 32 belonging respectively to two directly consecutive blocks 16 of the second row 36*b*. In this scenario, the two adjacent locking members 32, belonging to two separate blocks 16, together have a complementary shape to that of the space 40 wherein these two members are inserted.

This configuration with the protection blocks 16 in a U shape is also applicable to cases where the latter are successive along the longitudinal direction 8 in the annular space 18, the arms of the U of the second row 36*b* then serving to limit and/or prevent longitudinal distancing between the blocks 16, by cooperating with the spaces 40 defined between the arms of the U shapes of the first row 36*a*.

Obviously, due to the preferred shape identity between the U-shaped blocks of the two rows 36*a*, 36*b*, it could alternatively be possible to consider that the two arms of each block 16 of the first row 36*a* respectively form the two locking members 32 of this block, whereas the space defined between the two arms of each block 16 of the first row 36*b* would then form two adjacent hollows 34 merging circumferentially into one another, and intended to receive two arms and/or members 32 belonging respectively to two directly consecutive blocks 16 of the first row 36*a*.

Figure 11:
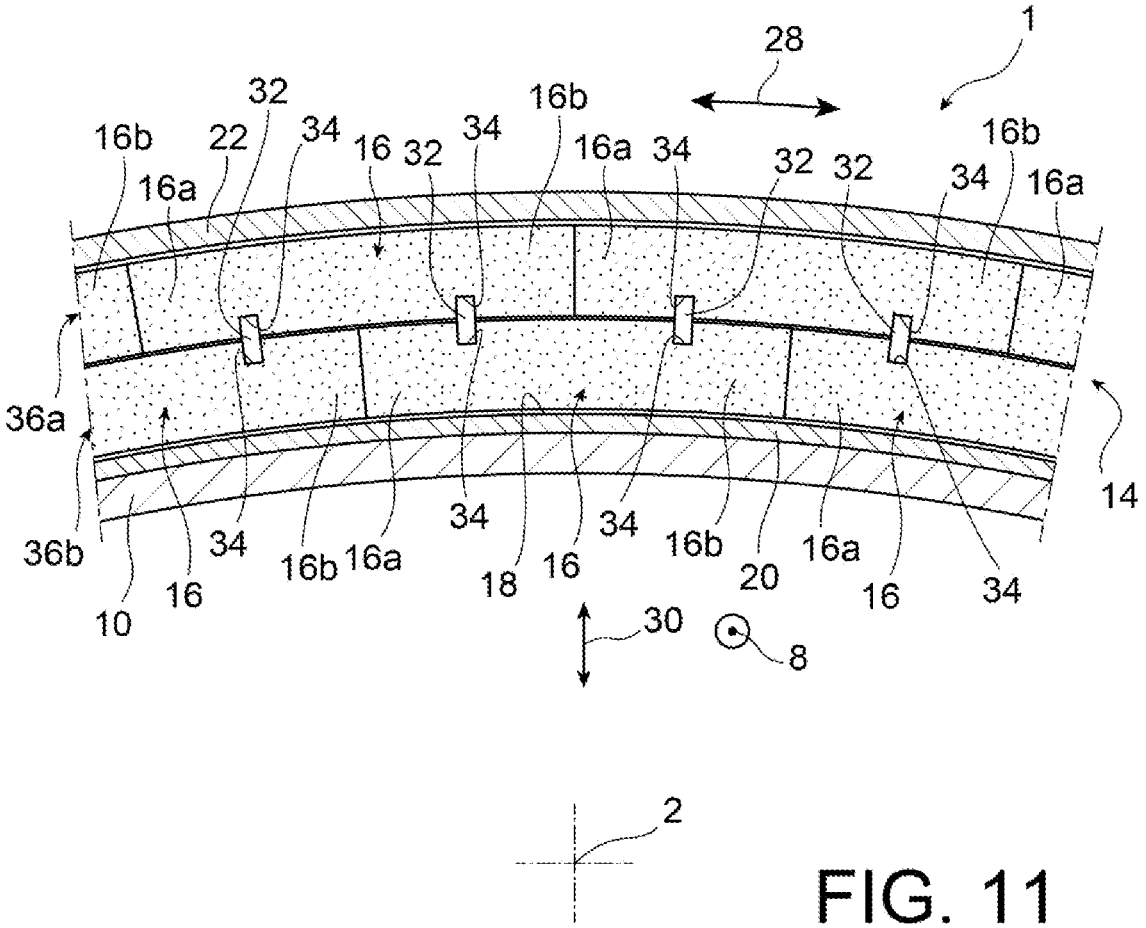
FIG. 11 represents a similar view to that of FIG. 8, with the package presented in the form of a further preferred embodiment of the invention.

Furthermore, once again in the case of a design with a double annular row of blocks 16, it is also possible to provide configurations with locking members 32 separate from these blocks 16, and not integrated therewith. For example, in FIG. 11, the protruding members are replaced by radially oriented pins 32 wherein the two opposite ends are housed in two hollows 34 belonging respectively to two blocks 16 of which one belongs to the first row 36*a*, and in which the other belongs to the second row 36*b*. For two given blocks 16, several pins 32 can be provided spaced apart from one another along the longitudinal direction 8. Alternatively, the pin(s) 32 can be replaced by a key extending along the same longitudinal direction 8, with the two opposite edges thereof housed in two hollows 34 each in the form of a longitudinal groove.

Obviously, various modifications can be made by those skilled in the art to the invention described above, merely by way of non-limiting examples and according to the scope defined by the appended claims. In particular, the different preferred embodiments described above can be combined, and the features thereof remain interchangeable.

The invention claimed is:

1. A package for transporting and/or storing radioactive materials, comprising a cavity for housing radioactive materials, as well as a radiological protection device arranged around the housing cavity in an annular space centred on a longitudinal central axis of the package, the radiological protection device comprising:

radiological protection elements arranged in the annular space;

at least two successive radiological protection elements in a given direction of the annular space, from a longitudinal direction and a circumferential direction of this space; and a locking member designed to limit and/or prevent the distancing of the two radiological protection elements relative to one another in the given direction is provided in the space, the locking member cooperating with or being integrated in a first element from said two radiological protection elements, and cooperating with a hollow formed on a second element of the two radiological protection elements.

2. The package according to claim 1, wherein the locking member is integral with the first radiological protection element.

3. The package according to claim 2, wherein the locking member is a longilinear member.

4. The package according to claim 3, wherein the longilinear locking member extends orthogonally or substantially orthogonally to said given direction.

5. The package according to claim 1, wherein the locking member is a separate part from the first and second radiological protection elements, and in that this locking member also cooperates with a hollow formed on the first radiological protection element.

6. The package according to claim 5, wherein the locking member is a part of smaller size than that of the first and second radiological protection.

7. The package according to claim 5, wherein the locking member is a pin, a key, or a clip.

8. The package according to claim 5, wherein the locking member only extends along a part of the radial thickness of the annular space.

9. The package according to claim 1, wherein the first and second radiological protection elements are directly consecutive in said given direction, in a single annular row of radiological protection elements.

10. The package according to claim 1, wherein the first and second radiological protection elements belong respectively to two concentric annular rows of radiological protection elements, the first and second radiological protection elements being thus circumferentially offset relative to one another while partially overlapping in a radial direction of the annular space.

11. The package according to claim 10, wherein the locking member is located at the level of a radial overlap zone of the first and second radiological protection elements.

12. The package according to claim 1, wherein the annular space is defined by an inner ferrule and an outer casing.

13. The package according to claim 12, wherein the annular space is devoid of heat conductors connecting the inner ferrule to the outer casing.

14. The package according to claim 1, wherein the radiological protection elements are neutron protection elements.

15. The package according to claim 1, wherein at least one radiological protection element of the radiological protection device is associated with two locking members designed to limit and/or prevent the distancing thereof, in said given direction, respectively relative to each of the two radiological protection elements located on either side thereof in this same given direction.

16. The package according to claim 2, wherein the locking member has a cross-section in the shape of a truncated disk, square or trapezium.

17. The package according to claim 5, wherein the locking member is made of a different material than that of the first and second radiological protection elements.

18. The package according to claim 1, wherein the radiological protection elements are cast resin blocks.

19. The package according to claim 1, wherein each radiological protection element is associated with two locking members designed to limit and/or prevent the distancing thereof, in said given direction, respectively relative to each of the two radiological protection elements located on either side thereof in this same given direction.

* * * * *